United States Patent [19]

Estrup

[11] Patent Number: 4,911,093

[45] Date of Patent: Mar. 27, 1990

[54] RIGGING AND SAIL SYSTEM FOR SAILBOAT

[75] Inventor: Peter V. S. Estrup, Longboat Key, Fla.

[73] Assignee: Joan Bergstrom, Longboat Key, Fla. ; a part interest

[21] Appl. No.: 163,698

[22] Filed: Mar. 3, 1988

[51] Int. Cl.[4] ..... B63H 9/10

[52] U.S. Cl. ..... 114/106; 114/3.91; 114/102; 114/107

[58] Field of Search ..... 114/39.2, 89, 90, 94, 114/95, 96, 97, 98, 102, 104, 105, 106, 107, 111

[56] References Cited

U.S. PATENT DOCUMENTS

| | | | |
|---|---|---|---|
| 94,277 | 8/1869 | Brown | 114/107 |
| 425,122 | 4/1890 | Cook . | |
| 633,705 | 9/1899 | Smith | 114/102 |
| 685,943 | 11/1901 | Pool | 114/39.1 |
| 1,700,660 | 1/1929 | Williams | 114/90 |
| 3,132,620 | 5/1964 | Court | 114/106 |
| 3,580,203 | 5/1971 | Martin | 114/39 |
| 4,196,687 | 4/1980 | Newick | 114/106 |
| 4,487,148 | 12/1984 | Umeda | 114/106 |
| 4,543,899 | 10/1985 | Walker | 114/97 |
| 4,685,410 | 8/1987 | Fuller | 114/102 |
| 4,702,191 | 10/1987 | Minami et al. | 114/106 |
| 4,703,707 | 11/1987 | Anderson | 114/102 |

FOREIGN PATENT DOCUMENTS

| | | | |
|---|---|---|---|
| 2447833 | 4/1976 | Fed. Rep. of Germany | 114/97 |
| 3120472 | 1/1983 | Fed. Rep. of Germany | 114/106 |
| 461784 | 2/1951 | Italy | 114/102 |
| 91493 | 7/1980 | Japan | 114/107 |
| 18597 | 1/1982 | Japan | 114/39.1 |
| 60-121193A | 6/1985 | Japan . | |
| 9204 | 9/1848 | Sweden . | |
| 10489 | 7/1899 | Sweden . | |
| 192394 | 2/1960 | Sweden . | |
| 2581 | of 1802 | United Kingdom . | |
| 198649 | 5/1924 | United Kingdom | 114/39.1 |

OTHER PUBLICATIONS

Aero-Hydrodynamics of sailing, Marchat, Chapter D Three-Dimensional foils.

*Primary Examiner*—Sherman D. Basinger
*Assistant Examiner*—Thomas J. Brahan
*Attorney, Agent, or Firm*—William E. Mouzavires

[57] ABSTRACT

A rigging and sail system for a sailboat including a rotatable mast having mounted thereon for rotation therewith, a pair of upper and lower booms extending transversely of the mast. The booms are connected to the mast through upper and lower tension members extending between the mast and the outer ends of the booms respectively and vertical fore and aft tension members extending between outer end portions of the booms on opposite sides of the mast. A pair of sails such as a main and jib are sheeted to and between the booms on opposite sides of the mast to be movable with the booms relative to the hull, and with the jib being movable relative to the booms to allow self-tacking during use merely upon steering the sailboat across the wind. The booms also provide horizontally extending air barriers above and below the upper and lower horizontal edges of the sails respectively to prevent or reduce loss of air across the sail edges while also channelling the air to flow horizontally along the surface of the sails in the fore-aft direction. In one embodiment, the main sail is attached at its leading edge to a furling sleeve received about the mast for rotation to allow furling upon rotation of the sleeve. The leading edge of the jib is attached about the fore tension member or about a furling sleeve rotatably received about the tension member. Several other embodiments are disclosed.

33 Claims, 4 Drawing Sheets

FIG. 1
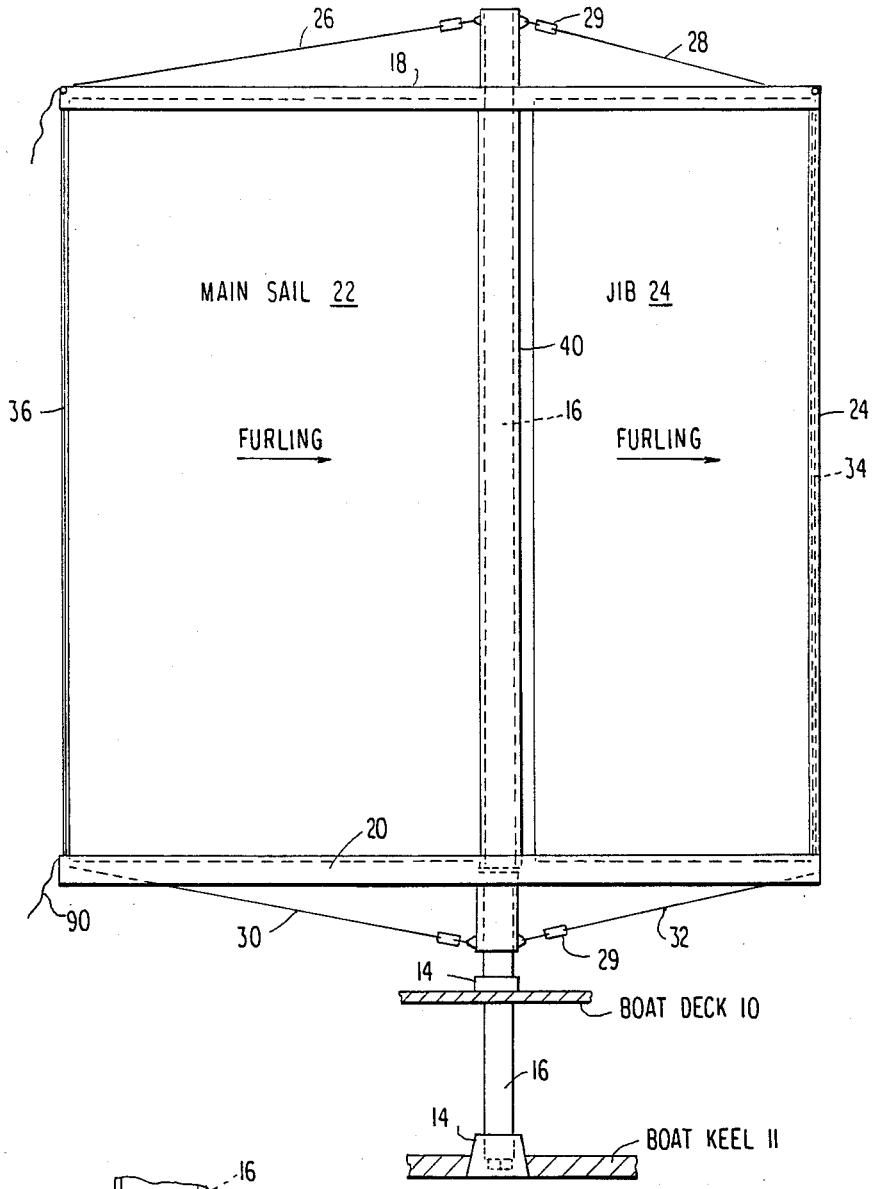
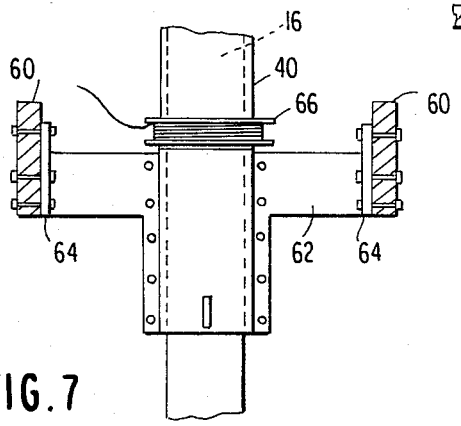
FIG. 7
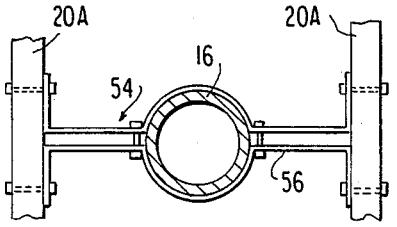
FIG. 2

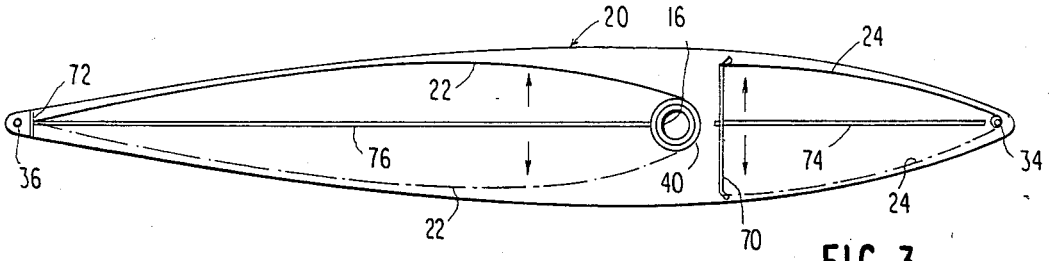
FIG.3
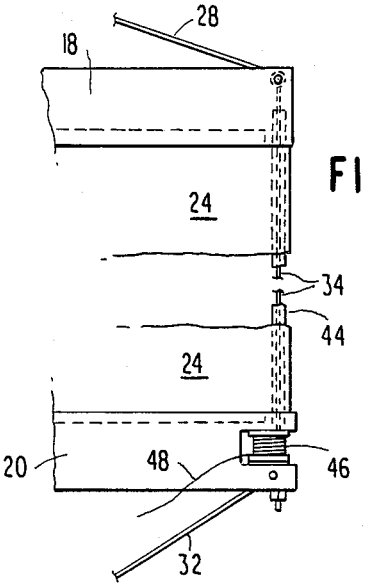
FIG.4
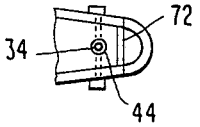
FIG.4A
FIG.5
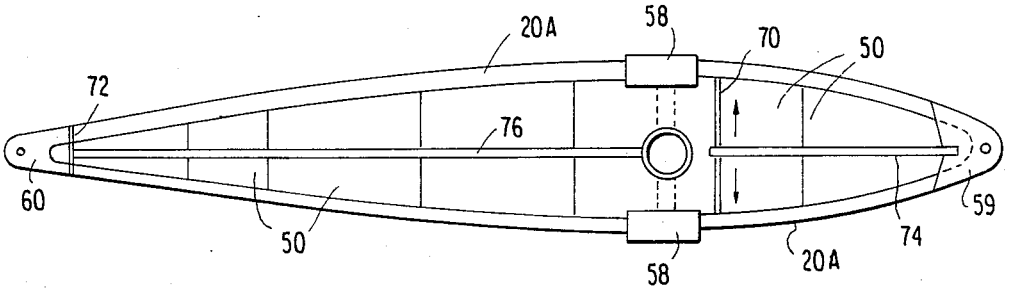
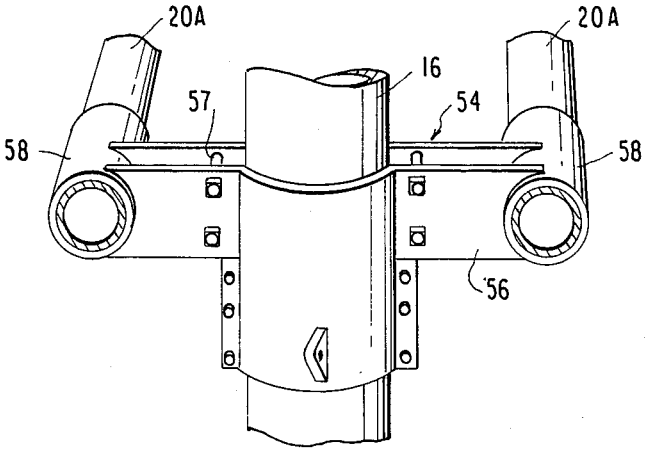
FIG.6

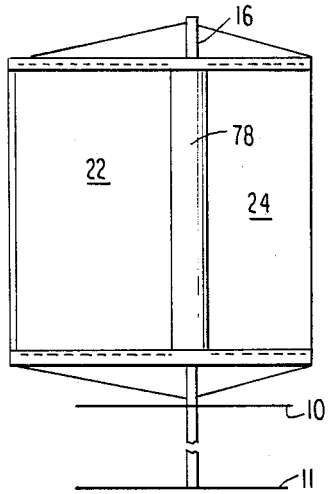
FIG. 8
FIG. 9
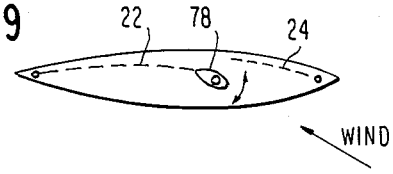
FIG. 9A
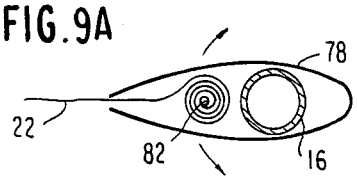
FIG. 9B
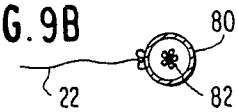
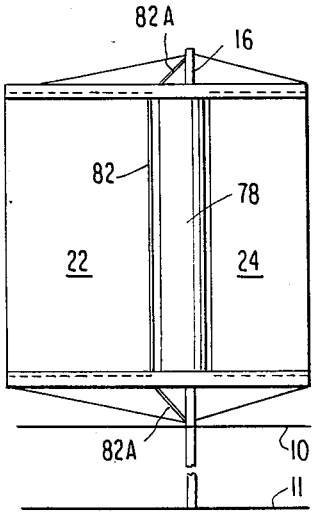
FIG. 10
FIG. 11
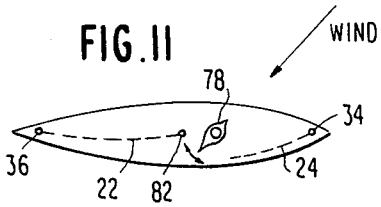
FIG. 11A
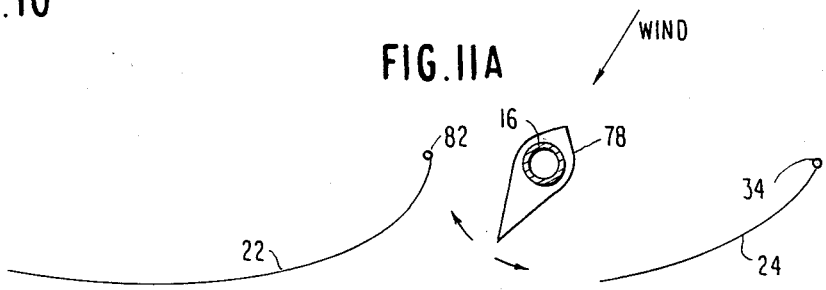

FIG. 12
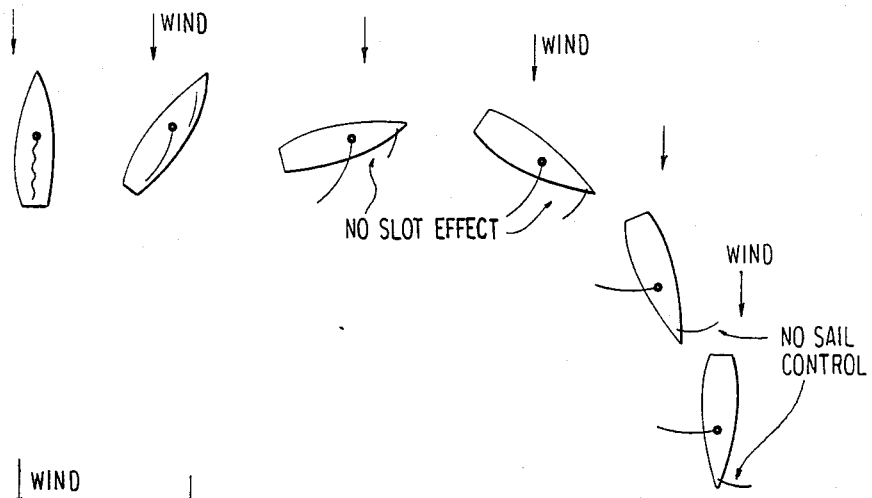
FIG. 13
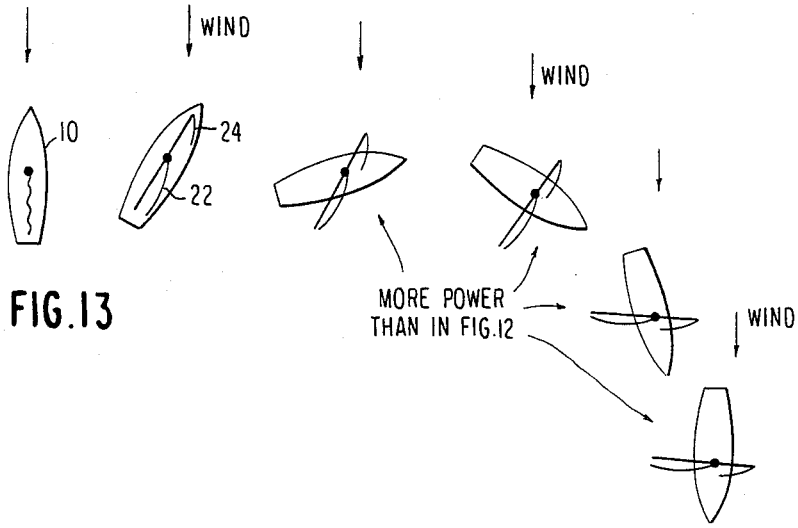
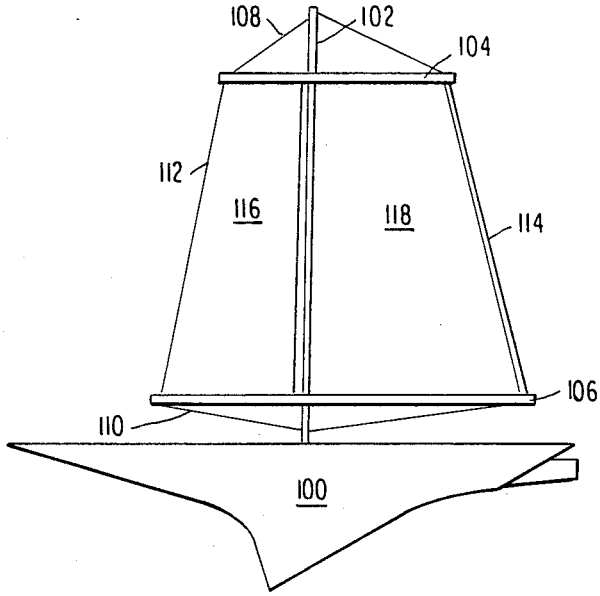
FIG. 14
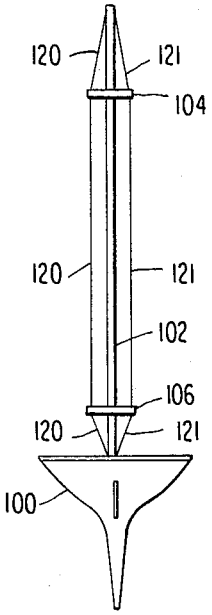
FIG. 15

RIGGING AND SAIL SYSTEM FOR SAILBOAT

OBJECTS OF THE PRESENT INVENTION

The present invention relates to a novel rigging and sail system for sailboats such as positive displacement, planing or catamaran or trimaran sailboats and other sailing craft including without limitation wind surfers and other high speed sailing craft.

An object of the present invention is to provide a novel rigging and sail system offering improved aerodynamic efficiency and reduced drag while significantly reducing pressure losses to either side of the sails when compared to conventional systems. Included herein is such a system that offers reduced drag from the rigging and mast and that may be utilized to significantly reduce tip vortices and to achieve higher lift/drag, effective aspect, and mast diameter/mean sail chord, ratios than certain conventional systems such as a Bermudian rig.

Another object of the present invention is to provide a novel rigging and sail system which will reduce bending loads on the mast while also favorably resolving the loads within the system to enable the system members to be made of relatively lightweight materials.

A further object of the present invention is to provide such a system which will allow increased control of the sail shape as well as the use of rectangular or trapezoidal shaped sails while also offering greater sail efficiency and reduced drag governed by the plan form shape of the sail when compared to conventional sails.

A still further object of the present invention is to provide a novel rigging and sailing system that is self-tacking and self feathering and which facilitates sailing in other ways.

A still further object of the present invention is to provide such a rigging and sail system that may be economically manufactured for use on various types and sizes of sailboats and which may be finally assembled and tuned with a mast as a unit in the shop or boat yard prior to installation on the associated boat and which can be removed from the boat without disconnecting rigging.

SUMMARY OF THE INVENTION

In summary, the invention is embodied in a rigging and sail system including a pair of upper and lower booms extending transversely relative to a mast while also being rotatable about the vertical axis of the mast such as may be effected by a rotatable mast. At least one sail which may be rectangular or trapezoidal in shape is sheeted to and between the booms to be rotated with the booms, however, in the preferred embodiment, jib and main sails are included on opposite sides of the mast with the leading edge of the mainsail sheeted to the mast or a furling sleeve rotatable about the mast. The leading edge of the jib is sheeted to a tension member extending between the booms and with the trailing edge of the jib free to move across the booms to be self-tacking in use.

The booms are rigged to the mast by tension members extending between the booms and between the booms and the mast such that the loads are transferred from the tension members to the booms as opposing compression loads acting longitudinally through the booms in opposing directions to thereby substantially balance the loads while reducing bending loads on the mast. In order to promote the proper flow of air horizontally along the fore-aft direction of the sails while reducing the loss of pressure across the upper and lower edge portions of the sails, the booms are provided with horizontal surfaces of sufficient lateral dimension to act as air barriers channeling the air to flow in the desired direction.

DRAWINGS

Other objects and advantages of the present invention will become apparent from the following more detailed description taken in conjunction with the attached drawings in which:

FIG. 1 is an elevational view of a sail and rigging system constituting a preferred embodiment of the invention with portions of the hull, deck and keel removed for purposes of brevity;

FIG. 2 is a fragmental plan view showing portions of a mast and boom assembly included in the system of the present invention;

FIG. 3 is a plan view of a lower boom included in the system and with dotted lines indicating an opposite position of the sails;

FIG. 4 is a side elevational view illustrating another embodiment incorporating a mechanism for furling the jib for reefing purposes;

FIG. 4A is a fragmental plan view of the leading end portion of one of the booms incorporated in the embodiment of FIG. 4;

FIG. 5 is a plan view similar to FIG. 3 but additionally showing horizontal air barriers and a cross strut incorporated in the frame of the boom;

FIG. 6 is a fragmental perspective view as seen from the bow of a boat of portions of the mast, cross strut and pipe sleeves incorporated in the system;

FIG. 7 is a fragmental cross-sectional view of a mast and boom assembly of another embodiment of the invention;

FIG. 8 is a side elevational view in diagrammatic form of another embodiment of the present invention incorporating an air deflector sleeve between the mainsail and jib;

FIG. 9 is a plan view in diagrammatic form of the system shown in FIG. 8 during sailing and with the sails being shown in dotted lines;

FIGS. 9A and 9B are enlarged plan views in diagrammatic form of portions of the system of FIGS. 8 and 9;

FIG. 10 is a view similar to FIG. 8 but showing another embodiment of the present invention;

FIG. 11 is a plan view in diagrammatic form of the system shown in FIG. 10 during use on a boat and with sails being indicated in dotted lines;

FIG. 11A is an enlarged plan view in diagrammatic form of portions of the system included in the embodiment of FIGS. 10 and 11;

FIG. 12 is a plan view in diagrammatic form of a sailboat with a conventional Bermudian rig in successive stages of sailing from a direction upwind to a direction downwind;

FIG. 13 is a view similar to FIG. 12 but depicting the rig of the present invention;

FIG. 14 is a side elevational view of a sailboat incorporating another embodiment of the present invention but with side stays of the rigging system removed for clarity; and FIG. 15 is an end elevational view taken from the stern of the sailboat of FIG. 14 but with the sail and the aft rigging stay removed for clarity.

DETAILED DESCRIPTION

Referring to the drawings in detail, there is shown for illustrative purposes only in FIG. 1, a preferred embodiment of the rigging and sail system of the present invention as incorporated in a sailboat which may be of the positive displacement, planing or catamaran or trimaran-type and which may have any conventional hull construction including a deck 10 above a keel 11. The system includes a mast 16 which, in the preferred embodiment, is mounted by bearings 14 for free rotation about the vertical axis of the mast relative to the deck 10. Fixed to the mast at spaced locations along the mast 16 are a pair of booms 18 and 20 which extend transversely of the mast. The booms 18 and 20 are spaced from each other to accommodate therebetween a mainsail 22 and a jib 24 which may be made of any suitable and preferably flexible material and in the shown embodiment, are rectangular in shape. In the preferred embodiment, the locations of the mast 16 along the length of the booms is about one-third the boom length starting from the forward end of the boom. This enables the entire system to be self-feathering relative to the deck because of the different effective sail areas presented by the main sail and jib coupled with the rotatability of the mast. Other mast locations can be employed as well. The mast 16 is centered along the longitudinal axis of the booms and along the transverse dimension of the booms at the mast location. Although the booms 18 and 20 are shown in FIG. 1 as being of the same length, in another embodiment shown for example in FIGS. 14 and 15, the upper boom may be shorter in length than the lower boom in which case the sails may have a trapezoidal shape to match the configuration of the booms.

Booms 18 and 20 are supported relative to the mast 16 by a novel rigging system including in the preferred embodiment upper tension members or stays 26 and 28 connected at their inner ends to the mast above the boom 18 and at their outer ends to outer end portions of the boom 18. The rigging system further includes lower tension members 30 and 32 connected at their inner ends to the mast 16 below the lower boom 20 and at their outer ends to end portions of the lower boom 20. The rigging system further includes vertically extending fore and aft tension members or stays 34 and 36 connected to and between the outer ends of the upper and lower booms on opposite sides of the mast respectively (as shown in FIG. 1), preferably at the locations where the upper and lower tension members 26, 28 and 30 and 32 are connected to the booms so that all of the tension members lie generally in the same plane. As their name suggests, the tension members are under tension and they exert compression forces on the booms which forces are opposed in direction along the booms so that they are substantially neutralized. The upper and lower tension members 26, 28, 30, 32 exert opposite compression forces on the mast which are neutralized to reduce bending loads. Although it is preferred that the tension members 26, 28, 30, 32, 34 and 36 be made from steel rods ("rod rigging"), other materials such as wire or cable may be employed. Moreover it is conceivable that the rigging or tension members may be made from plates or structural frame or beam members integral with or connected to the booms. Any suitable means such as turnbuckles 29 may be provided for tensioning the tension members of the preferred embodiment with control.

In the preferred embodiment the leading vertical edge of the mainsail 22 is sheeted relative to the mast 16, and in the preferred embodiment this is effected through means of an elongated tubular sleeve 40 which is telescoped about the mast 16 for rotation relative thereto and extends between the upper and lower booms 18 and 20 (see FIGS. 1 and 3). The leading edge of the mainsail 22 is attached along the sleeve 40 so that upon rotation of the sleeve 40 about the mast 16, the main sail 22 may be furled about the sleeve to reef the main sail in its horizontal dimension. Moreover, during sailing when the sails are under wind, the rotation of the sleeve about the mast will, as shown in FIG. 3, position the leading edge of the sail 22 to one side of the mast to improve the sail shape to accommodate efficient flow of air between the jib 24 and mainsail. FIG. 3 shows the sails 22 and 24 in full lines when on one tack and in dotted lines when on an opposite tack. Although, in another embodiment (shown for example in FIGS. 14 and 15) where sleeve 40 is omitted, the leading edge of the mainsail 22 may be directly attached to the mast 16, the preferred embodiment is that which employs a furling sleeve as shown in FIGS. 1, 2 and 3. FIG. 7 shows another embodiment where a furling drum 66 is attached to the sleeve 40 to rotate the same upon rotation of the drum with a line wound about the drum. Moreover, in other embodiments not shown, the sails may be rigged to allow slab reefing along the vertical dimension of the sail.

In the embodiment shown in FIGS. 1 and 3, the leading edge of the jib 24 is simply attached about the fore tension member 34. However, in the preferred embodiment shown in FIG. 4, a mechanism is provided to enable the jib 24 to be furled about the fore tension member 34 to enable reefing along the horizontal dimension of the jib 24. Referring to FIG. 4, this mechanism includes a cylindrical sleeve or tube 44 received about the fore tension member 34 to be rotatable about the same. The leading edge of the jib 24 is attached to the sleeve 44 so that upon rotation of the sleeve 44 about the fore stay 34, the jib 24 will be furled for reefing. Any suitable means may be provided for facilitating rotation of the sleeve 44, such as a drum or reel 46 fixed coaxially to the lower end of the sleeve 44 to be rotated by a line 48 wound about the drum 46 as shown in FIG. 4.

Referring now to FIG. 5, the upper and lower booms 18 and 20 are both provided with horizontal surfaces 50 extending laterally with sufficient dimension throughout the length of the booms to act as air barriers or dams located above and below the upper and lower horizontal edge portions of the sails. These barriers will guide and channel the air to flow generally horizontally in the proper fore-aft direction along the contour of the sails and to prevent or minimize the loss of air pressure across the upper and lower horizontal edge portions of the sails to either side thereof when sailing. This will avoid or reduce tip vortices and the overall result is an increase in the effective sail area and pressure over the entire sail. Although it is preferred that the upper and lower horizontal edges of the sails engage the associated booms to establish a seal at that interface, a slight spacing between these sail edges and the booms will also result in an increase in the effective sail area but not as great as in the preferred embodiment.

The booms 18 and 20 may have any suitable construction, however, a preferred lightweight construction is shown in FIGS. 2, 5 and 6 where elongated aluminum tubes or pipes 20A form the opposite spaced sides of a frame between which sides, panels of lightweight sheet material or diaphragms 50 are attached to form the horizontal surfaces which provide the air barriers described above. As shown in the embodiment of FIG. 6, the boom tubes 20A are provided with a cross strut 54 fixed to the mast 16 by opposed plates 56 clamped by bolts 57 about the mast 16. Plates 56 are provided with socket sleeves 58 on opposite sides thereof for receiving boom tubes 20A. The opposite ends of the boom tubes 20A are received in gussets 59 and 60 which are formed with sleeves for receiving the boom tubes 20A.

Instead of an aluminum tubular frame, the booms 18 and 20 may be constructed with wood frame members 60 shown in the embodiment of FIG. 7. This embodiment also utilizes a strut 62 similar to that described above and shown in FIG. 6 with the exception that strut 62 has end flanges 64 bolted to the wood frame members 60. FIG. 7 also shows a furling drum 66 fixed to the bottom of sleeve 40 for rotating the sleeve 40 to reef the main sail 22 as described above.

In addition to the constructions shown in FIGS. 5, 6 and 7, the booms 18 and 20 may have other suitable constructions such as, for example, solid fiberglass, composite or wood members (not shown) formed in one or more pieces with a planar surface in the horizontal direction to provide the air barriers described above.

Referring now to FIGS. 3 and 5, the jib 24 is connected at its upper and lower trailing edge portions to the booms 18 and 20, respectively to be self-tacking relative to the booms. This is accomplished in the shown embodiment by transverse tracks or guides 70 respectively secured across the lower surface and upper surface of the upper and lower booms 18 and 20, respectively. Tracks 70 are fixed at their opposite ends to the frame tubes 20A of the booms in the specific embodiment shown in FIGS. 3 and 5. Lines from the upper and lower trailing edge corner portions of the jib are connected to the tracks or guides 70 to be movable along the same to permit self-tacking of the jib across the booms. Similar guides or tracks 72, but of shorter length, are also provided across the booms at the gussets 59 and 60 thereof for tying the mainsail 22 thereto.

In order to facilitate reefing of the sails 22 and 44 in the preferred embodiment, longitudinally extending tracks 74 and 76 are secured along the longitudinal axes of the upper and lower booms at the lower and upper surfaces thereof, respectively, as shown in FIGS. 3 and 5. The inner ends of tracks 74 and 76 may be secured in any suitable manner to the frames of the booms. The outer ends of the tracks 74 and 76 are secured to the gussets 59 and 60 at the opposite ends of the booms. The upper and lower horizontal edges of the sails 22 and 24 are received in the tracks for reefing. This also in effect seals the upper and lower horizontal edge portions of the sails to the booms to prevent loss of air across the edge portions of the sails and this effect is augmented by the horizontal surface portions of the booms on opposite sides of the sail which contain the air to flow in the desired direction along the sails in generally the fore-aft direction. The transverse dimension of the booms is therefore designed accordingly with sufficient length.

Referring now to FIGS. 8 through 9B, there is shown another embodiment of the invention which utilizes an air deflector sleeve 78 telescoped about the mast while extending between and to the booms to reduce drag that would otherwise result from the contour of the mast 16. Air deflector sleeve 78 also serves to maintain attached air flow from the jib 24 to the mainsail 22 to direct the air flow from the jib to the main sail with reduced turbulence. This should increase the total lift of the main sail. The contour of the air deflector sleeve 78 is thus designed accordingly, and in the shown embodiment it has a generally teardrop shape as shown in FIG. 9A. In this embodiment, the leading edge of the main sail is attached to a rotatable furling sleeve 80 which is telescoped about a vertical wire cable stay 82 extending within the deflector sleeve 78 to and between the upper and lower booms where the stay 82 is secured rearwardly of the location of the mast 16. The trailing edge of the air deflector 78 is provided with a vertical slot throughout the length thereof for admitting the sail 22 into the air deflector sleeve 78 to be wound about the furling sleeve 80 for reefing upon rotation of furling sleeve 80. FIG. 9B is an enlarged showing of the furling sleeve 80 and stay 82. The jib and the trailing edge of the main sail in this embodiment may be sheeted in the manner described above and therefore need not be repeated here. In use, the air deflector sleeve 78 is rotatable about the mast 16 to accommodate lateral movement of the sail under wind.

Referring now to FIGS. 10 through 11A, another embodiment of the invention is shown similar to that of FIGS. 8 through 9B with the exception that the wire cable stay 82 to which the leading edge of the main sail 22 is attached is located outside of and just aft of the air deflector sleeve 78 which is rotatable about the mast 16 as described above. While a furling sleeve is not shown in this embodiment, it is obvious that one could be employed about stay 82 if desired. The stay 82 in the instant embodiment may be anchored to the mast as shown at 82A in FIG. 10.

In use the entire rigging and sail system is controlled by a single sheet line 90 which may be attached to the upper and lower boom or even the aft stay 36. This avoids the need of jib sheets, winches and related deck hardware which have encumbered sail boats for years. FIG. 13 shows sequential steps of turning down-wind with a boat incorporating the present invention while FIG. 12 shows a similar sequence with reference to a boat having a Bermudian rig. Even though the boat 10 of FIG. 13 progressively moves down-wind, the efficiency of the sails is maintained since they are sheeted to the rotatable booms. In contrast, the Bermudian rig loses power due to the loss of the slot effect and the control over the positioning of the sails. In order to tack with boat 10 all that is required is to steer across the wind with the rudder since the system will self tack upon relative rotation between the hull and the booms. Moreover should the operator lose control such as when he is overpowered, he merely needs to release tension on the main sheet 90 to cause instant feathering in response to the wind to allow him to gain control.

FIGS. 14 and 15 illustrate another embodiment of the present invention in a sailboat having a hull 100, a mast 102 upstanding from the hull and a rigging system having upper and lower tension members or stays 108 and 110 respectively and fore and aft tension members or stays 112 and 114 respectively similar to the system of FIG. 1. However in the rigging and sail system of the present embodiment the upper boom 104 has a shorter length than the lower boom 106 and the jib and main sails 116 and 118 have a trapezoidal shape as shown in FIG. 14 to match the configuration of the booms 104 and 106.

The embodiment of FIGS. 14 and 15 further differs from the embodiment of FIG. 1 in that side stays 120 and 121 are added on opposite sides of the mast 102 to absorb laterally directed loads on the mast to resist lateral bending of the mast 102. Side stays 120 and 121 are attached at their opposite ends to the mast 102 above and below the booms 104, 106 and at their intermediate portions to opposite sides of the upper and lower booms 104 and 106 as shown in FIG. 15. Because of the additions of these side stays 120, 121 the cross section of the mast 102 may be reduced to lighten the mast while reducing drag presented by the mast. For purposes of clarity the aft stay 114 and main sail 118 shown in FIG. 14 have been omitted from FIG. 15.

Although in all of the embodiments shown and described above, the main sail has been shown with a straight leech or trailing edge, sails with curved leechs (not shown) may also be employed in practicing the present invention. Moreover in such cases a pair of aft tension members or stays (not shown) may be employed on opposite sides of the sail and located inwardly from the outer aft ends of the booms and attached on opposite sides adjacent the edges of the booms to provide sufficient space to accommodate the natural shaping of the sail under wind when in use. Such an arrangement would also lend itself to slab reefing which would be easily effected under guidance of the double aft stays.

From the above it will be seen that the present invention provides a unique rigging and sail system in which the rigging and sail loads are resolved in the system into tension loads on the tension members which, in turn, impose compression forces on the booms acting longitudinally along the booms in opposing directions and compression loads on the mast such that the compression loads are substantially balanced or easily absorbed by the mast. This substantially reduces bending loads on the mast allowing the mast to be designed with a reduced crosssection for lightness and minimum drag. Additionally, the use of conventional boom vangs are entirely obviated by the present invention due to the fore and aft tension members whose tension loads are resolved in the booms as stated.

Since the sails are permanently sheeted to the booms, the necessity of resetting and tying the sails to the deck when changing direction is avoided with the present invention.

In addition, the booms as utilized in the system of the present invention, not only provide a permanent sheeting base for the sails independent of the deck of the boat but they also provide air barriers maintaining the proper flow of air along the sails in the fore-aft direction while preventing or reducing loss of air across the upper and lower edges of the sails and eliminating tip vortices. Furthermore the present invention allows the center of effort of the sails to be reduced without sacrificing sail efficiency. In use the rigging and sail system of the present invention is easily controlled by a single line handled by a single operator without the necessity of winches and deck hardware required in conventional systems and without the necessity of releasing and resecuring the jib sheet during each tack. Indeed tacking of the jib is automatic merely by steering the boat across the wind.

What is claimed is:

1. A rigging system for sailing craft such as a sailboat comprising in combination:

a mast, upper and lower booms mounted on the mast and extending transversely relative to the mast and being adapted for rotation together as a unit about a generally vertical axis extending through the mast when mounted on a sailing craft, means interconnecting the booms and the mast including upper and lower tension members extending between the mast and the booms at locations above and below the upper and lower booms respectively, and fore and aft tension members interconnecting the upper and lower booms on opposite sides of the mast, said upper and lower tension members and said fore and aft tension members being rotatable with said booms as a unit about said vertical axis, and wherein the upper and lower booms are spaced from each other for accommodating a sail to be sheeted to and between the upper and lower booms, and wherein the tension members are under tension and the booms and mast are under compressive forces from the tension members acting longitudinally through the booms and mast.

2. The system defined in claim 1 wherein said booms include air barriers extending along their lengths for reducing loss of air about the edges of the associated sail during use.

3. The system defined in claim 1 including a first sail extending vertically between the booms and being sheeted thereto for movement with the booms.

4. The system defined in claim 3 including a sleeve located and rotatable about the mast and wherein the sail has a leading edge connected to the sleeve for rotation therewith.

5. The system defined in claim 3 including a second sail extending vertically between the booms on the side of the mast opposite the first sail, aid second sail having a leading edge connected to the fore tension member and an opposite trailing edge movable relative to the booms to be self-tacking during use.

6. The system defined in claim 5 including an air deflector having a predetermined surface shape mounted to and extending along the mast between said sails to guide the flow of air between said sails.

7. The system defined in claim 6 including a vertical stay extending between the upper and lower booms and wherein the leading edge of the first sail is secured about said vertical stay.

8. The system defined in claim 6 wherein said deflector is a sleeve located and rotatable about the mast.

9. The system defined in claim 8 including a vertical stay located within said deflector and extending between the booms and wherein the first sail has a leading edge extending about said vertical stay.

10. The system defined in claim 8 including a vertical stay located rearwardly of the deflector and extending between said booms and wherein the first sail has a leading edge secured about said vertical stay.

11. The system defined in claim 7 including a furling sleeve located about said vertical stay and wherein the leading edge of the first sail is connected to the furling sleeve.

12. The rigging system defined in claim 1 wherein the booms are each rigidly fixed to the mast and extend across the mast as a unit to be rotatable with the mast in use.

13. A sailing craft comprising in combination; a hull a mast upstanding from the hull and having a longitudinal axis, upper and lower spaced booms extending in a direction transversely relative to the mast and being rotatable together as a unit about the longitudinal axis of the mast, rigging means interconnecting the booms and the mast such that the rigging means is under tension and exerts compressive forces on the lower boom and mast longitudinally of the lower boom and mast, said rigging means including fore and aft tension stays extending between the upper and lower booms, and lower tension members extending from said lower boom to said mast, a first sail extending vertically between said booms and being sheeted to said booms for movement with the booms relative to the hull, and wherein said rigging means, booms and sail are rotatable together as a unit about said axis relative to the hull in response to wind and steering of the hull during use.

14. The sailing craft defined in claim 13 wherein there is included a second sail sheeted relative to the booms forwardly of the mast and with a leading edge sheeted about said fore stay and a trailing edge movable relative to the booms to be self-tacking.

15. The sailing craft defined in claim 14 wherein said booms have horizontally extending means on opposite sides of upper and lower edges of said sails forming air barriers for channeling the flow of air generally in the fore-aft direction of the sails while reducing the loss of air across said upper and lower edges of said sails.

16. The sailing craft defined in claim 13 wherein said booms have means forming air barriers for guiding flow of air along the sail generally in a fore-aft direction of the sail while reducing loss of air across the edges of the sail.

17. The sailing craft defined in claim 13 wherein said mast is rotatable relative to the hull about the longitudinal axis of the mast, and wherein said booms are fixed to the mast to be rotatable with the mast as a unit.

18. The sailing craft defined in claim 13 including a second sail sheeted to and between the booms fore of the mast with said first sail located aft of the mast.

19. The sailing craft defined in claim 13 wherein said sail has generally horizontally extending upper and lower edges located adjacent surface portions of the booms respectively to reduce flow of air between said edges and booms.

20. The sailing craft defined in claim 18 including an air deflector surface located along the mast and between said first and second sails to guide the flow of air between said sails.

21. The sailing craft defined in claim 20 wherein said deflector is a sleeve telescoped about said mast while being rotatable about and relative to said mast.

22. The sailing craft defined in claim 21 wherein said first sail has a leading edge located within said deflector sleeve.

23. The sailboat defined in claim 21 wherein said first sail has a leading edge located adjacent the deflector sleeve externally of the deflector sleeve.

24. The sailing craft defined in claim 13 further including a sleeve telescoped about said mast for rotation relative to the mast, and wherein said first sail is attached along said sleeve for rotation therewith relative to the mast.

25. The sailing craft defined in claim 14 further including a sleeve telescoped about said fore stay for rotation relative thereto and said second sail is attached along said sleeve for rotation therewith relative to said fore stay.

26. The sailing craft defined in claim 13 wherein said booms each have longitudinally extending tracks respectively receiving the upper and lower edges of said sail.

27. A sailing craft defined in claim 13 wherein:

said rigging means includes upper and lower tension members extending between the mast and the booms such that the tension members are under tension and the booms and mast are under compressive forces from the tension members and stays.

28. A sail and rigging system for a sailing craft comprising in combination, a mast, upper and lower booms mounted on the mast and extending transversely thereof with the mast intersecting longitudinal axes of the booms, rigging means including fore and aft stays extending between the upper and lower booms, a first sail having a forward edge sheeted to and between said booms and a trailing edge movable across said booms in response to wind conditions, a second sail sheeted to and between said booms and located rearwardly of said mast with said first sail located forwardly of said mast and sheeted to the fore stay, both of said sails having upper and lower edges adjacent said upper and lower booms respectively, and, wherein said booms, sails and rigging means are rotatable as a unit about the axis of said mast when in use on a sailing craft.

29. The system defined in claim 28 wherein said second sail has a forward edge sheeted about said mast and a rearward edge constituting a leech edge.

30. The system defined in claim 28 wherein said sails are made of flexible sheet material.

31. The system defined in claim 28 wherein said booms are rigidly fixed to said mast and the mast is adapted to be rotatable when in use on a sailing craft.

32. A sail craft comprising in combination:

a hull, a mast upstanding from the hull and being rotatable relative to the hull about a longitudinal axis of the mast, upper and lower spaced booms rigidly fixed to the mast and extending transversely relative thereto and being rotatable with the mast relative to the hull about said longitudinal axis of the mast, said upper and lower booms having a transverse dimension, a first sail sheeted to and between the booms to be movable with the booms relative to the hull, said sail having upper and lower edges extending adjacent surface portions of the booms to prevent loss of air between the edges of the sails and the surfaces of the booms, a second sail sheeted to and between the booms forwardly of the mast and with said first sail being located aft of said mast, said second sail having a trailing edge movable relative to the booms within said transverse dimension to be self-tacking in use in response to movement across the wind, said booms having means located on opposite sides of the sail to provide barriers channelling the flow of air in a generally fore-aft direction along the sail, and wherein said booms and sail are rotatable with the mast about said axis as a unit in response to wind and steering conditions during use, and wherein said sails are contained within the booms.

33. The sailing craft defined in claim 32 wherein said first sail has a leading edge sheeted about said mast.

* * * * *